United States Patent [19]

Edwards

[11] 4,027,650

[45] June 7, 1977

[54] FIREPLACE ENCLOSURE

[75] Inventor: Harrison F. Edwards, Norwich, N.Y.

[73] Assignee: Bennett-Ireland, Inc., Norwich, N.Y.

[22] Filed: Jan. 12, 1976

[21] Appl. No.: 648,387

[52] U.S. Cl. ..... 126/140; 126/202

[51] Int. Cl.[2] ..... F23M 7/00

[58] Field of Search ..... 126/140, 202, 138; 160/DIG. 9; 292/DIG. 30, DIG. 68, 145–154, 175; 49/73

[56] References Cited

UNITED STATES PATENTS

| | | | |
|---|---|---|---|
| 1,892,447 | 12/1932 | Carr et al. | 292/DIG. 68 |
| 3,372,689 | 3/1968 | Goudy | 126/140 |
| 3,457,907 | 7/1969 | Brunig | 126/140 |
| 3,913,558 | 10/1975 | Caldwell | 126/140 |

*Primary Examiner*—John J. Camby
*Assistant Examiner*—Larry I. Schwartz
*Attorney, Agent, or Firm*—H. Gibner Lehmann; K. Gibner Lehmann

[57] ABSTRACT

A fireplace enclosure comprising a frame having two vertical side members and two transverse cross members extending therebetween, two pairs of hingedly connected folding doors for closing off the space encompassed by the frame, and a pair of slide latches connected with elongate slidable handles on two of the doors respectively for conveniently selectively latching and releasing the doors from the frame. The frame includes a door stop in the form of a depending apron on the upper cross member, constituting a backing for the doors when they are in closed positions. A pair of retainer slide members is carried on the innermost two doors, respectively, for engagement with the rear surface of the apron to prevent the doors from swinging freely outward as they are opened or closed. The arrangement is such that both the unlatching and the opening of each door pair can be readily accomplished by a single movement of the handle carried by one of the doors of the pair.

Another form of the invention involves a fireplace enclosure having a pair of chain-operated, collapsible wire-mesh screens which slide along aligned rods having looped or bent connecting portions. The loops in the rod enable the screens to overlap an extent when closed, and also provide a simple guide for coextensive portions of the chain, without the need for complex channels or additional chain guide mechanisms.

11 Claims, 13 Drawing Figures

12
14
16
132
133
136
138
140
146
200
202
204
206
208
210
212
214
216
218
219
220
221
222
224
226
228
230
232

FIREPLACE ENCLOSURE

BACKGROUND

This invention relates generally to fireplace enclosures, and more particularly to panelled enclosures of the type employing one or more sets of hinge-connected folding doors.

Prior enclosures of the folding door type have employed pairs of lugs on the free ends of the two inner doors, wherein the lugs were adapted to ride in tracks or grooves in the upper or lower cross supports of the frames. Typically, in units having four door panels the outer two were hingedly connected to the frame, with the inner two being connected respectively to the outer two by hinges. By such an arrangement, each of the inner panels could be folded onto its respective outer panel as the hinge joining the two was shifted outwardly.

While such a construction operated satisfactorily, there was a tendency for the lugs to bind in the tracks, especially if the latter became dirty, or if the doors became slightly warped. As a result, smooth operation was difficult to achieve, particularly after the unit had been in use over a substantial length of time.

Prior latch mechanisms for the doors tended to be either too complex and expensive to produce, or ineffective in that they were difficult to operate. In many cases, the handles for such latch mechanisms were located directly in front of the fire and thus tended to become excessively hot after several hours.

Frequently, one or more collapsible wire mesh screens were employed with a glass door enclosure, to confine the burning ashes while still permitting heat convection into the room. The pull-chain mechanisms employed with such screens often involved complex guides or channels for the chain. In addition, problems were encountered where it was desired to have a slight overlap of the screens, as opposed to having them merely abut one another. Many prior units were thus both costly to produce and sometimes ineffective in use.

SUMMARY

The above disadvantages and drawbacks of fireplace enclosure units are obviated by the present invention, which has for an object the provision of a novel and improved enclosure which is especially convenient to use, simple in construction, easy to install and reliable in operation. A related object is the provision of an improved enclosure as above, which greatly minimizes the tendency for binding of the doors, and which provides simple yet effective latches therefore, to thereby enable independent control of the door panels on either the left or right half of the enclosure.

Still another object is the provision of a fireplace enclosure which is inexpensive to manufacture, and which employs an absolute minimum number of separate parts.

The above objects are accomplished by a unique enclosure construction, comprising basically a frame having vertical side members and substantially horizontal top and bottom members extending therebetween, a door stop carried by one of the members, and two pairs of hinged doors for closing off the space encompassed by the frame and engageable with the door stop when they are closed. Means are provided for mounting the doors on the frame for movement between open and closed positions, and an elongate handle is slidably carried on one of each of the door pairs.

Associated with the doors that carry the handles are means responsive to sliding movement of the handles for selectively latching the respective doors to the frame and releasing them therefrom. The arrangement is such that when either pair of hinged doors is closed, the latch for that pair can be operated by shifting the handle in a door-opening direction parallel to the upper and lower members. The location of each latch is sufficiently close to the hinge of the corresponding hinge-connected doors, to retain the doors and hinge against outward swinging movement.

In another form of the invention, the objects are accomplished by a fireplace enclosure comprising a basic frame as above described, having two pairs of doors and means mounting the same as aforesaid, together with a depending apron on an upper frame member to extend behind the doors when the latter are closed. Additionally provided are retaining guide or slide members on two of said doors, extending behind the apron of the top frame member and engageable with the back surface thereof to pilot the doors during opening and closing movements of the latter. Handles are carried adjacent the guide members on two of the doors, for operating the latter. Since the retaining guide members loosely engage the back surface of the apron while the doors engage the front surface thereof, and since no tracks or guide grooves are involved, the operation of the doors is especially smooth, with seizure and binding being virtually eliminated.

In still another form of the invention, the objects are accomplished by a fireplace enclosure comprising a frame and a pair of overlappable collapsible wire mesh screens carried by and slidable along a pair of curtain rods which are mounted at the rear of the frame. A pull-chain is connected with the operlapping ends respectively of the screens, and extends around a pulley or direction-reversing device at one side of the frame. A chain guide at the frame center provides bends on loops in the rods for confining co-extensive portions of the chain, such that the latter is adequately supported. The guide is extremely simple in construction while at the same time minimizing the possibility of kinking or binding of the chain, and this is an important feature of the invention.

Features of the invention reside in the provision of a fireplace enclosure which is both rugged and sturdy, and capable of providing satisfactory performance over an extended life.

Other features and advantages will hereinafter appear. In the drawings, illustrating a preferred embodiment of the invention:

Figure 1:
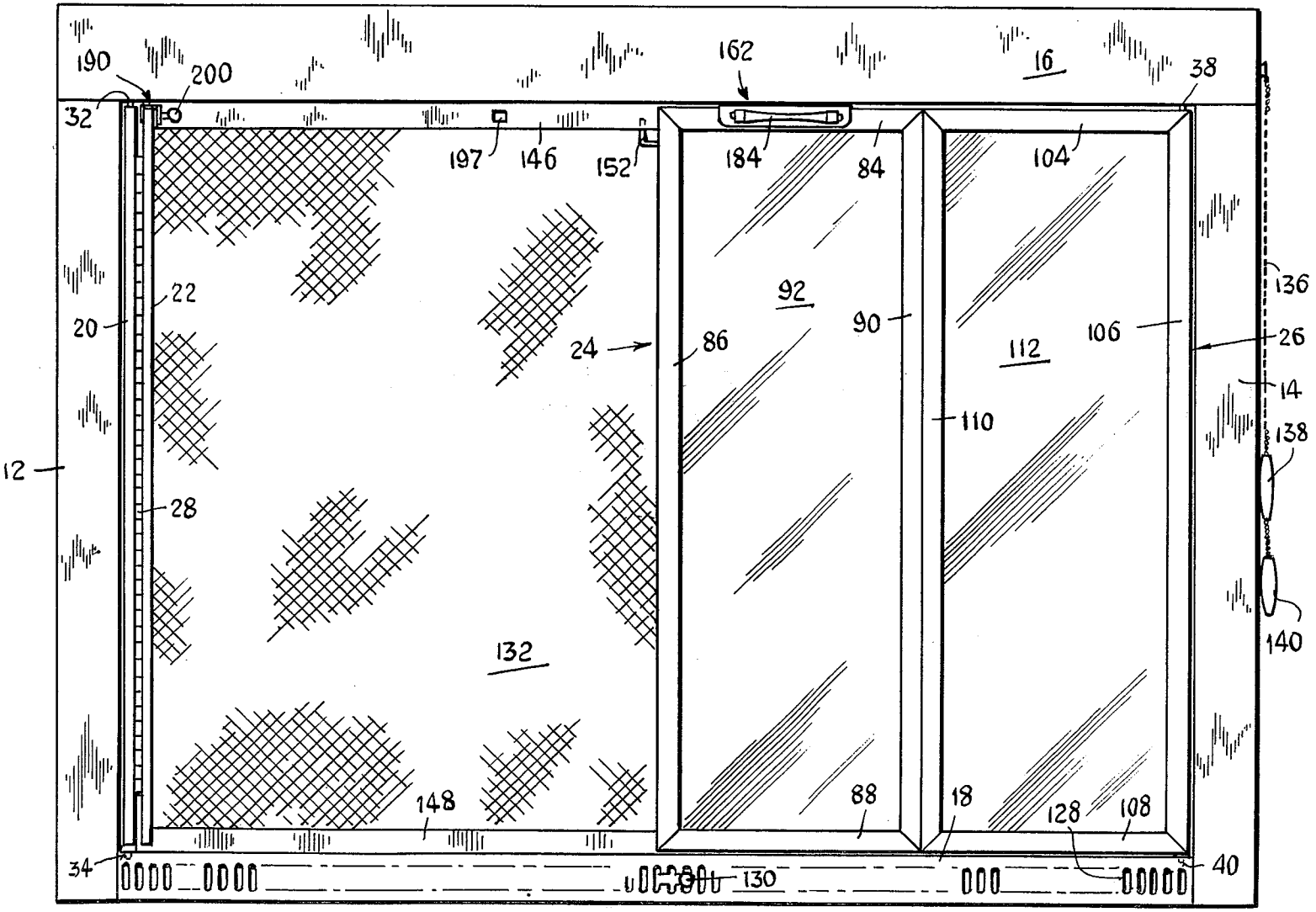
FIG. 1 is a front elevational view of the improved fireplace enclosure of the present invention, shown with one pair of hinged doors open and the other pair closed.
Figures 2, 3, 4, 5:
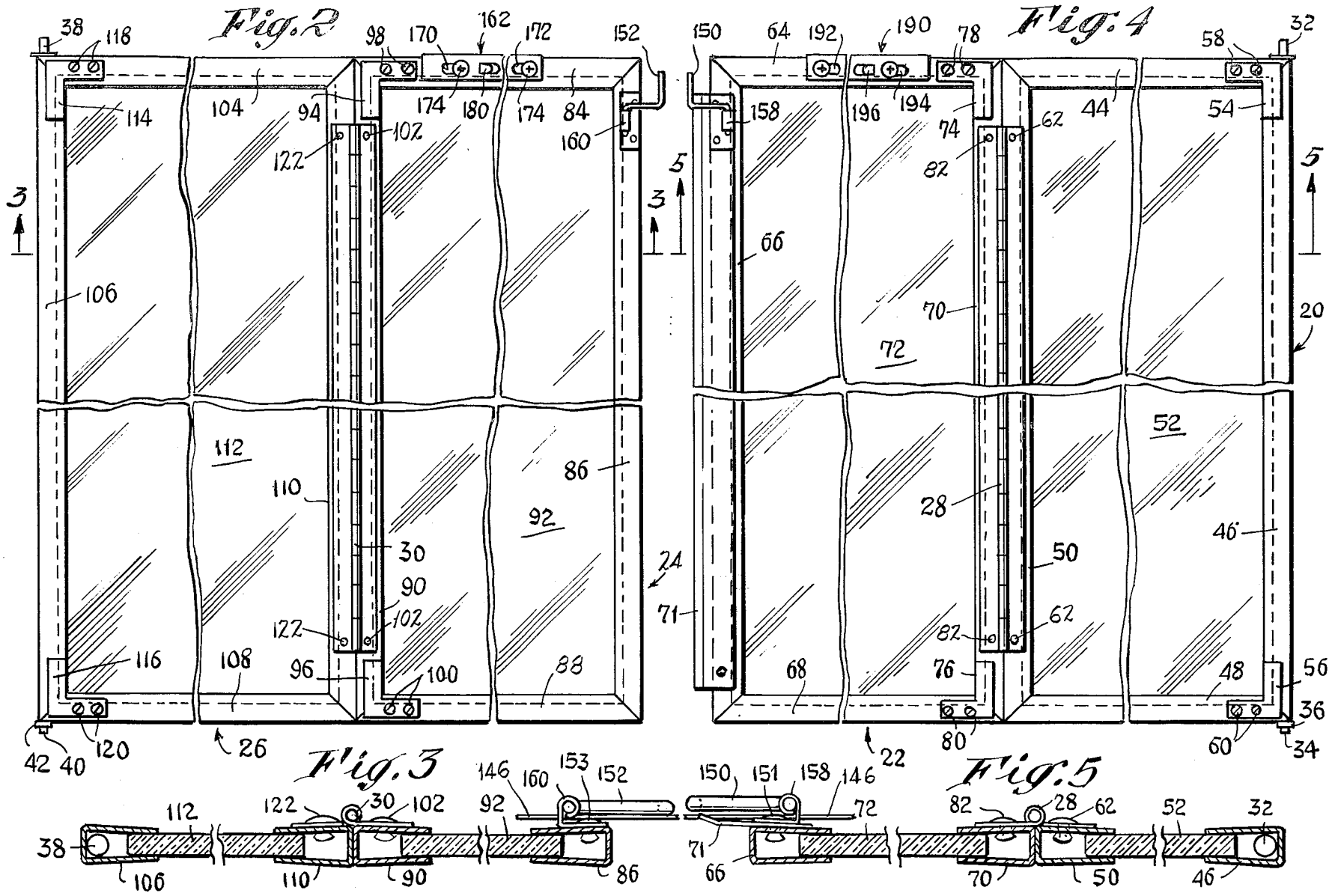
FIG. 2 is a rear elevational view of the two right-hand doors of FIG. 1, and particularly illustrating the latch mechanism and retainer means associated therewith.
FIG. 3 is a vertical section taken on line 3—3 of FIG. 2.
FIG. 4 is a rear elevational view of the two left-hand doors of FIG. 1, and illustrating the latch mechanism and retainer means associated therewith.
FIG. 5 is a vertical section taken on line 5—5 of FIG. 4.
Figure 6:
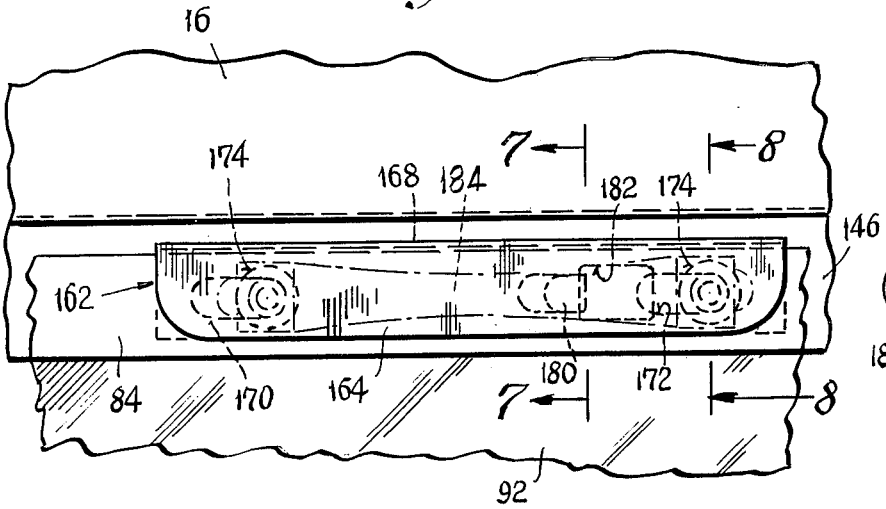
FIG. 6 is a fragmentary front elevational view of the inner one of the right-hand doors in FIG. 1, particularly showing details of the latch construction associated therewith.

Referring first to FIG. 1, there is illustrated an enclosure for fireplaces comprising a rectangular frame which includes a pair of vertical side members 12, 14, and a pair of substantially horizontal top and bottom members 16, 18 respectively extending therebetween. The frame is secured in place in front of a fireplace by suitable brackets or clamps (not shown) which are well known in the art. Carried by the horizontal members are two pairs of hingedly connected swinging doors 20, 22 and 24, 26. As shown in FIGS. 2 and 4, the two left doors 20, 22 are pivotally connected by means of a hinge 28, the same being true of the two right-hand doors 24, 26, connected by a hinge 30. A pair of aligned pins 32, 34 supports the door 20 and are received in holes in the top and bottom members, respectively to enable pivotal movement of the door 20 about their common axis. The lower pin includes an enlargement 36 constituting a spacer bearing for maintaining the lowermost edge of the door 20 spaced slightly above the bottom member 18. Similarly, aligned pins 38, 40 rigidly carry the door 26 and are received in holes in the upper and lower members 16, 18 respectively, the pin 40 including an enlargement or spacer bearing 42. Such an arrangement enables the doors 20, 22 to be swung outwardly and folded back upon one another in the manner illustrated in FIG. 1, with a minimum of sliding contact with either the member 16 or 18. Especially smooth operation and freedom from binding and seizure are thus realizeable.

As particularly shown in FIGS. 2–5, the door 20 comprises a glass pane 52 surrounded by channel-like support members 44, 46, 48 and 50, the hinge 28 being secured to the latter by means of rivets 62. The members 44 and 48 are secured with rivets 58, 60 to angle brackets 54, 56 respectively, which have been welded to the member 46.

Similarly, the door 22 includes a glass pane 72 which is carried by support members 64, 66, 68 and 70 with brackets 74, 76 being welded to the member 70 and secured to the members 64, 68 by rivets 78, 80 respectively. The hinge 28 is fastened to the member 70 by rivets 82. A flange 71 is carried on the member 66 and is adapted to close over the crack between the doors 22, 24 when the latter are both closed.

As shown in FIG. 2, the doors 24, 26 comprise panes 92, 112 carried by support members 84, 86, 88, 90 and 104, 106, 108, 110, respectively. Angle brackets 94, 96 and 114, 116 are associated with the doors 24, 26 respectively, secured by rivets 98, 100 and 118, 120. The hinge 30 is fastened to the members 90, 110 by rivets 102, 122 respectively.

The bottom member 18 includes ventilation openings 128 which are selectively closed off by a shutter (not shown) which is operated by an actuator lever 130. The frame carries two collapsible wire-mest screens 132, 133 which are shifted by a pull-chain mechanism comprising chain 136 and handles 138, 140. Due to the fact that the handles 138, 140 are disposed out of the direct radiation from the fire, they remain cool and thus pose no burn hazard to the operator. This has not been the case in many prior constructions when the handles for the screen were directly carried by the same.

Figure 8:
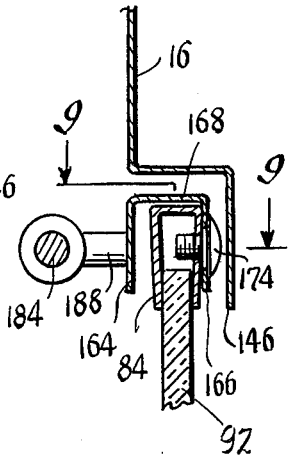
FIG. 8 is a section taken on line 8—8 of FIG. 6.

Referring to FIGS. 2–5 and in accordance with the present invention there is provided a guide for the two center doors 22, 24 for confining their innermost edges to sliding movement substantially in the plane defined by the members constituting the frame. In accomplishing this the top member 16 includes a depending apron or door stop 146 which is slightly offset toward the rear with respect to the member 16 (FIGS. 7, 8) so as to form a recess to receive the doors 20–26. Similarly, the bottom member 18 includes an upstanding apron or door stop 148 (FIG. 1) which is slightly offset to define a similar recess. Cooperable with the upper apron 146 is a pair of retaining guide members on the doors 22, 24 constituted as relatively stiff wires 150, 152 each having a pair of reverse bends giving them the configuration of the latter Z, carried by brackets 158, 160. The latter include cylindrical sockets which respectively receive the ends of the wires 150, 152. The sockets are integral with the brackets respectively as shown. The free ends of the wires 150, 152 extend behind the apron 146 as particularly illustrated in FIG. 3 and 5, such that the adjacent edges of the doors 22, 24 will be restrained against outward swinging movement with respect to the frame. The wire pieces 150, 152 can swivel in the sockets of the brackets 158, 160 respectively, as dictated by the opening or closing of the door pairs. The ends of the wire pieces 150, 152 which protrude from the bottom of the sockets are slightly enlarged, to prevent the pieces from pulling out and becoming lost. Due to the small contact area between the apron and each door and wire guide, the frictional drag experienced during the opening and closing of the doors has been found to be extremely low. This feature, together with the provision of the spacer bearings 36, 42, results is especially smooth operation, with freedom from binding and seizure of the doors.

Figure 9:
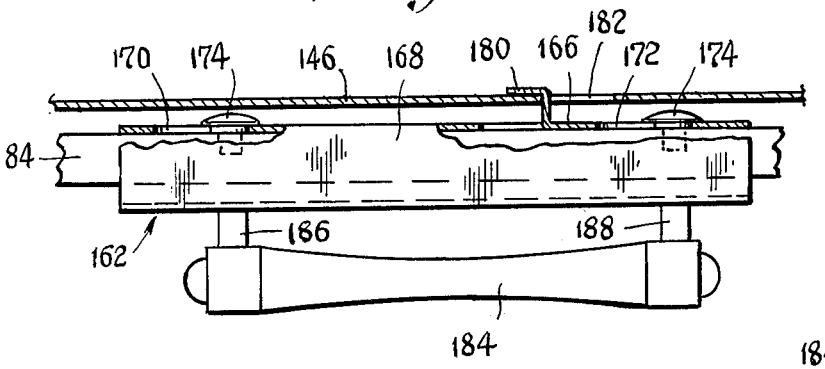
FIG. 9 is a section taken on line 9—9 of FIG. 8.
Figure 7:
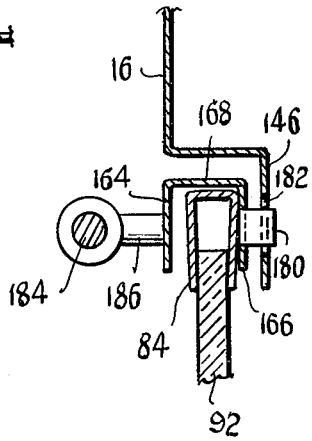
FIG. 7 is a section taken on line 7—7 of FIG. 6.
Figure 10:
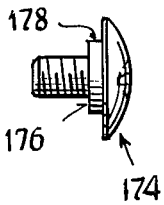
FIG. 10 is a side elevational view of a headed screw employed in the latch mechanism of FIGS. 6–9.

Referring now to FIGS. 2, 4 and 6–10 and in accordance with the present invention there are provided cooperable latch means on the apron 146 and on the doors 22, 24 and 26, 28 for maintaining them in closed positions. The latch for the doors 24, 26 is particularly shown in FIGS. 6–9 and includes a channel member 162 having front and rear legs 164, 166 respectively and a connecting yoke 168. The rear leg 166 includes two elongate slots 170, 172 by which the member 162 is slidably secured to the door 24. In accomplishing this, a pair of headed screws 174 of the type shown in FIG. 10 are provided, which are received in threaded holes in the member 84. The screws have stop shoulders 176 which limit the insertion thereof and provide a clearance area 178 directly beneath the head for receiving the slots 170, 172 in the leg 166. Referring particularly to FIGS. 7 and 9, there is also provided a lug 180 integral with the leg 66 and constituted as a stamping therefrom, receivable in a cooperable slot 182 in the apron 146 when the doors 24, 26 are closed. An elongated handle 184 is carried by two spacers 186,

188 secured to the leg 164 of the channel 162, for actuating the latch. It will be seen that the doors 24, 26 can be swung from an open position to the closed position of FIG. 1 wherein they overlie the apron 146, and wherein the lug 180 is received in the slot or recess 182. The door latch mechanism can then be made operative by actuation of the handle 184 toward the left in FIG. 1, to bring the lug 180 into latching engagement with the walls of the slot 182. FIG. 9 shows the channel 162 in the latching position. The releasing position would correspond to movement of the channel 162 toward the right in FIG. 9 wherein the lug 180 could be withdrawn from the slot 182.

The door 22 also includes a latch mechanism similar to that already described. It is shown in FIGS. 1 and 4 and includes a channel 190 having elongate slots 192, 194, and a stamped out lug 196. An elongate handle 200 enables sliding movement of the channel to be effected. The latter is mounted on two screws 174 similar to that of FIG. 10, with the stop shoulders 176 providing a clearance area 178 as in the previous embodiment. Latching of the door 22 in the closed position is accomplished by sliding the handle 200 toward the right wherein the lug 196 is seated behind the walls of a cooperable slot 197 in the apron 146. The above arrangement has the distinct advantage of extreme simplicity and low cost, while providing smooth operation and freedom from binding. In addition, the construction is pleasing to the eye, resulting in attractive overall appearance which adds to the desirability of the device.

Figures 11, 12, 13:
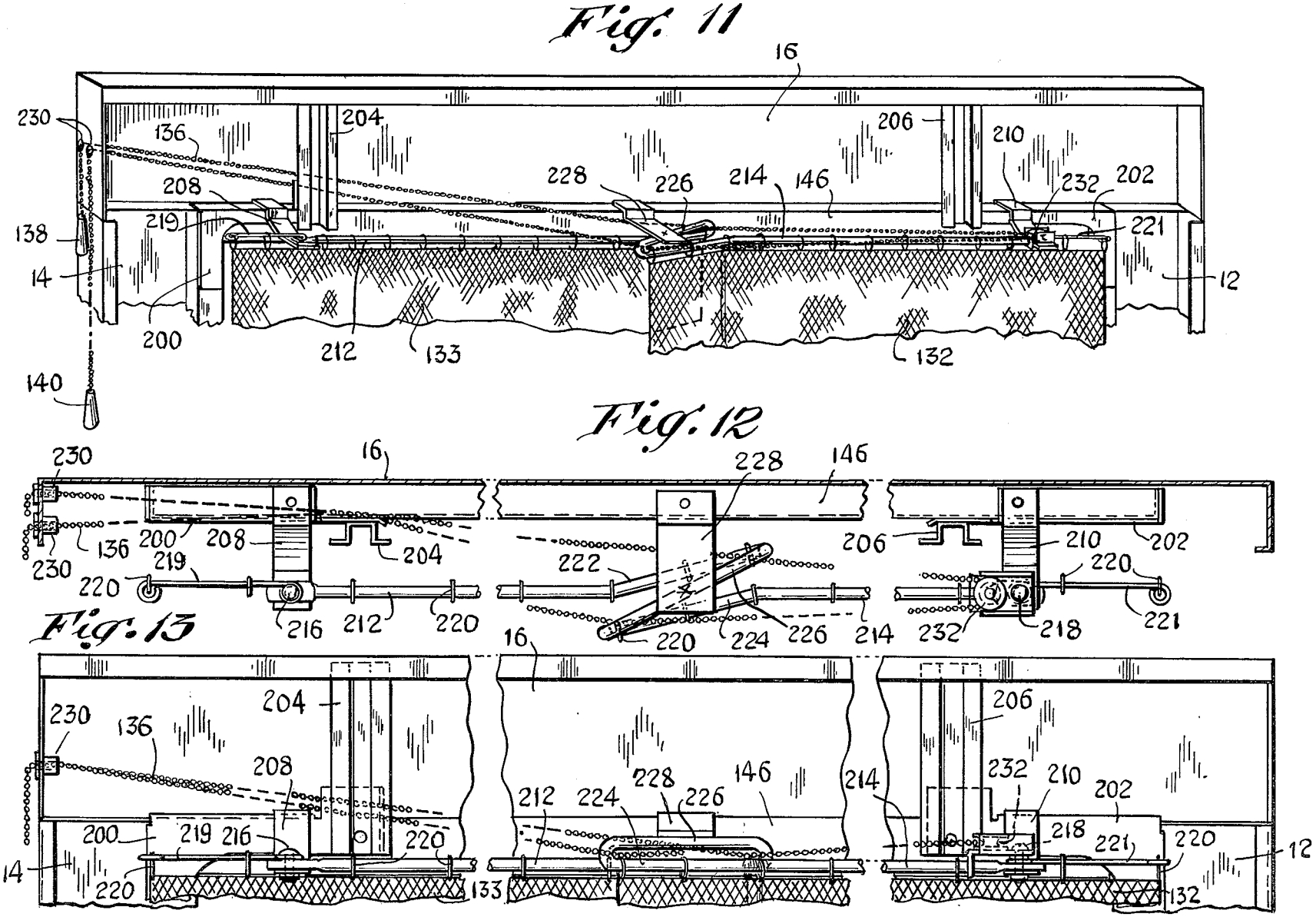
FIG. 11 is a perspective view of the rear of the fireplace enclosure of FIG. 1, particularly showing the two collapsible wire mesh screens and the pull-chain mechanism associated therewith.
FIG. 12 is a top plan view of the pull-chain mechanism per se, of the enclosure of FIG. 11.
FIG. 13 is a fragmentary rear elevational view of the enclosure and pull-chain mechanism of FIG. 11.

Referring now to FIGS. 11–13, joining the horizontal top member 16 and the slide member 14 is an L-bracket 200, secured by screws (not shown). A second L-bracket 202 joins the top member 16 to the member 12. A pair of vertical reinforcing brackets or struts 204, 206 is provided, the strut 204 being welded to the horizontal top member 16 and bolted to the L-bracket 200. The remaining strut 206 is welded to the top member 16 and bolted to the L-bracket 202 in the position shown.

Carried by the L-brackets 200, 202 respectively is a pair of horizontal support arms 208, 210. These in turn carry a pair of substantially aligned curtain rods 212, 214 by means of bolts 216, 218. Two two collapsible wire mesh screens 132, 133 include multiple rings 220 which slide along the rods 212, 214. Small wire extensions 219, 221 on the rods 212, 214 support the two opposite edges of the screens 133, 132 adjacent the side members 14, 12, respectively.

In accordance with the present invention, the rods 212, 214 are constituted as a single piece, being bent to have overlapping portions which enable the two screens 132, 133 to overlap when closed, and thus providing a centrally-located guide for the chain 136. Two of the portions 222, 224 are parallel to one another and are hereinafter referred to as carrier portions, joined by a support portion 226. The portion 226 is askew with respect to the carrier portions, as shown, and the latter are angularly disposed with respect to the substantially aligned rods 212, 214. As shown in FIGS. 11 and 12, the support portion 226 is welded to a third horizontal support arm 228 carried by the horizontal top member 16.

One portion of the chain 136 is attached to the innermost ring 220 supporting the screen 132, while another portion of the chain is secured to the innermost ring 220 supporting the screen 133. The arrangement is such that when the screens are drawn together by operation of the chain, they can overlap in the manner of FIG. 11 due to the offset provided by the two carrier portions 222, 224 of the rods. With such a construction, the rods 212, 214 and portions 222–226 can conveniently be constituted as a single integral piece, resulting in a simpler device which is more economical to manufacture and produce. Coextensive sections of the chain pass through the two loops formed by the rod portions 222–226, the loops providing support for the chain adjacent the center of the horizontal top member 16. The end portions of the chain pass through bushings 230 in the member 16 as shown in FIG. 11, and a direction-reversing device or pulley 232 is carried on the bracket 210 for guiding the chain during its travel adjacent the member 12. such an arrangement has the advantage of extreme simplicity, without reliance or special complex guides or channels. Freedom from kinking of the chain and from binding of the screens is thus realizeable, and the ends of the chain which must be grasped are never overly hot, to cause burning or discomfort to the fingers.

From the above it can be seen that I have provided a novel and improved fireplace enclosure which is simple in construction, reliable in operation, and which can be constructed at extremely low cost.

The device is both rugged, and easy to use, and thus seen to represent a distinct advance and improvement in the technology of fireplace accessories.

Variations and modifications are possible without departing from the spirit of the invention.

I claim:

1. A fireplace enclosure, comprising in combination:
a. a frame having substantially vertical side members and substantially horizontal top and bottom members extending between and respectively connected to the side members,
b. a door stop carried by one of said members,
c. two pairs of hingedly connected folding doors adapted to close off the space encompassed by the frame, and to engage said door stop when closed,
d. means movably mounting the doors on the frame for movement between open and closed positions,
e. an elongate handle movably carried by one of said doors,
f. means for slidably mounting said handle on the one door for lengthwise movement,
g. cooperable latch means on said one door and frame, responsive to movement of said handle for selectively latching the door to the frame and releasing the door therefrom,
h. said handle mounting means comprising a channel having a U-shaped cross-section, said channel being slidable along the top edge of said one door,
i. said cooperable latch means comprising a lug stamped out from said channel, and
j. means defining an aperture in the door stop for receiving said lug when said latch means is actuated,
k. sliding of said handle effecting latching engagement of the lug and door stop.

2. A fireplace enclosure, comprising in combination:
a. a frame having substantially vertical side members and substantially horizontal top and bottom members extending between and respectively connected to the side members, b. two pairs of hingedly connected folding doors adapted to close off the space encompassed by the frame, c. means movably mounting the doors on the frame for movement between open and closed positions, d. the upper frame member having a depending apron adapted to extend behind the doors when the latter are closed, e. two of said doors having retaining guide members extending behind the apron of the top frame member and engageable with the back surface thereof, for piloting the doors during opening and closing movements of the latter, and f. handles carried on two of said doors adjacent the guide members, for operating the doors to open and close the same, g. said doors including means defining a pair of sockets, h. said retaining guide members comprising a pair of wire-like pieces received in said sockets respectively and capable of limited swinging movement therein, thus tending to prevent binding of the doors as they slide along the apron.

3. A fireplace enclosure, comprising in combination:

a. a frame having substantially vertical side members and substantially horizontal top and bottom members extending between and respectively connected to the side members, b. a door stop carried by one of said members, c. two pairs of hingedly connected folding doors adapted to close off the space encompassed by the frame, and to engage said door stop when closed, d. means movably mounting the doors on the frame for movement between open and closed positions, e. an elongate handle movably carried by one of said doors, f. means for slidably mounting said elongate handle on the one door for lengthwise movement along the upper edge thereof and in opposite directions substantially parallel to said upper edge, and g. cooperable latch means on said one door and frame, responsive to movement of said handle in a door-closing direction, for latching the door to the frame and for releasing the door from the frame when the handle is moved in the opposite, or door-opening direction.

4. The invention as defined in claim 1, and further including:

a means for limiting sliding movement of said channel on said one door between latching and releasing positions.

5. The invention as defined in claim 4, wherein:

a. said limiting means includes means defining an elongate slot in said channel, and b. a stud carried by said one door and receivable in the slot, c. said stud having a retainer head for holding the channel captive while permitting its sliding movement on the door.

6. The invention as defined in claim 5, wherein:

a. said limiting means further includes means defining an additional elongate slot in said channel, said additional slot being spaced from the first mentioned slot, b. an additional stud carried by said one door, spaced from the location of the first stud and receivable in the additional slot, c. said additional stud having a retainer head for holding the channel captive while permitting its sliding movement on the door.

7. The invention as defined in claim 5, wherein:

a. said stud includes a stop shoulder adapted to maintain the retainer head in spaced relation with respect to the door, thereby providing a clearance area for accommodating the walls of the channel adjacent the slot.

8. The invention as defined in claim 1, wherein:

a. said channel comprises a pair of leg portions and a connecting web portion, b. said handle being carried by one of said leg portions, c. said lug being disposed on the other of said leg portions.

9. A fireplace enclosure, comprising in combination:

a. a frame having substantially vertical side members and substantially horizontal top and bottom members extending between and respectively connected to the side members, b. two pairs of hingedly connected folding doors adapted to close off the space encompassed by the frame, c. means movably mounting the doors on the frame for movement between open and closed positions, d. the upper frame member having a depending apron constituting a door stop adapted to extend behind and engage the doors when the latter are closed, e. two of said doors having rearwardly-projecting guide members extending behind the apron of the top frame member and being freely slidable along the back surface thereof during opening and closing of the doors, for piloting the latter during such opening and closing movements and for preventing them from swinging freely outwardly, and f. handles carried on two of said doors adjacent the guide members, for operating the doors to open and close the same.

10. The invention as defined in claim 9, wherein:

a. said guide members comprise wire hooks respectively carried by said two doors, said hooks having portions extending behind said apron to prevent forward movement of the adjacent edge portions of the doors as they are opened or closed.

11. The invention as defined in claim 9, wherein:

a. said movable mounting means comprises a pin carried by one of said doors, engageable with the bottom member, and b. a spacer member carried by said pin and disposed between the bottom member and the bottom edge of said one door, for maintaining the latter spacer a distance above the member in order to eliminate sliding contact between the two.

* * * * *